US005363726A

United States Patent [19]

Smith

[11] Patent Number: 5,363,726

[45] Date of Patent: Nov. 15, 1994

[54] HAND OPERATED TOOL DRIVER

[76] Inventor: Gary A. Smith, 8038½ Harrison St., Paramount, Calif. 90723

[21] Appl. No.: 152,732

[22] Filed: Nov. 15, 1993

[51] Int. Cl.[5] ..... B25B 17/00

[52] U.S. Cl. ..... 81/57.29; 81/58.1

[58] Field of Search ..... 81/57.29, 57.39, 58.1, 81/61

[56] References Cited

U.S. PATENT DOCUMENTS 3,132,549 5/1964 Lee .
3,519,046 7/1970 Pierce .
3,941,017 3/1976 Lenker et al. .

*Primary Examiner*—James G. Smith

*Attorney, Agent, or Firm*—Macro Search Corp.

[57] ABSTRACT

Improved manually-powered drive tool means comprising a generally pistol-shaped housing having a barrel portion with a hand grip extending substantially perpendicularly from one end of the barrel portion, a drive shaft rotatably mounted in the barrel portion and projecting from the end of the barrel portion opposite the hand grip, a trigger lever pivotally connected adjacent the lower end of the hand grip, an arcuate drive gear connected to the upper end of the trigger lever for movement therewith, a differential gear means for coupling the drive gear to rotate the socket drive shaft, and reversing means for selectably connecting the trigger lever to rotate the differential gear means in a selected direction.

10 Claims, 2 Drawing Sheets

HAND OPERATED TOOL DRIVER

This application is substantially similar to the inventor's prior application, Ser. No. 556,272 filed on Jul. 23, 1990, now abandoned.

BACKGROUND FIELD OF INVENTION

This invention relates to hand tools, such as socket wrenches, screw drivers and the like, and is particularly directed to an improved hand actuated tool driver for turning fasteners.

PRIOR ART

Socket wrenches, screw drivers and similar hand tools are very well known in the art. Electrically and pneumatically driven tools are common and offer obvious advantages over hand driven tools. However, where electrical or pneumatic power is unavailable, such power drivers cannot be used. Many manually driven tools are available for driving a shaft with mechanical advantage. However, most of the prior art devices have been heavy, bulky and complex in construction and, hence, have been expensive to produce and have required considerable maintenance. A search in the United States Patent Office has revealed the following relevant patents: U.S. Pat. No. 3,019.681 to E. D. Grissom, U.S. Pat. No. 3,132,549 to A. W. Lee, U.S. Pat. No. 3,286,560 to J. R. Murray, U.S. Pat. No. 3,413,877 to F. J. Teichmeier, U.S. Pat. No. 3,519,046 to S. R. Pierce, and U.S. Pat. No. 3,941,017 to P. E. Lenker et al. The patent to Lee is superficially similar to the device of the present invention, but does not permit continuous driving of the crock by repeated actuation of the squeeze arm. Because the arcuate rack of Lee cannot disengage from the pinion gear, it is necessary to disengage the tool from the work in order to allow the ratchet gear to return to the forward position after each rearward movement of the squeeze arm. In the tool of Pierce, the rack is able to make the return stroke because of the shape of the teeth coupled with the fact that the rack is able to spring away from the drive pinion. This arrangement is unsatisfactory in that excessive tooth wear has be found to develop and the tool is noisy in operation. In contrast, with the device of the present invention, the links 60 permit the drive gear 44 to disengage from the ratchet pinion gear 42 during the return stroke. Thus, repeated actuation of the triggering lever 50 acts through the arc gear 44 to cause continuous rotation of the pinion gear 42. Lee cannot accomplish this. Each of the other references is subject to the limitations mentioned above. Thus, none of the prior art manually-powered socket drive tools have been entirely satisfactory.

BRIEF SUMMARY AND OBJECTS OF THE INVENTION

These disadvantages of prior art manually-powered socket drive tools are overcome with the present invention wherein a manually-powered socket drive tool is provided which is light weight, compact and simple in construction and which can be manufactured inexpensively and requires little, if any, maintenance. The advantages of the present invention are preferably attained by providing an improved manually-powered socket drive tool comprising a generally pistol-shaped tool having a barrel portion with a hand grip extending substantially perpendicularly from one end of the barrel portion, a socket drive shaft rotatably mounted in the barrel portion and projecting from the end of the barrel portion opposite the hand grip, a trigger lever pivotally connected adjacent the lower end of the hand grip, an arcuate drive gear connected to the upper end of the trigger lever for movement therewith, a differential gear means for coupling the drive gear to rotate the socket drive shaft, and reversing means for connecting the trigger lever to rotate the differential gear means in a selected direction. Accordingly, it is an object of the present invention to provide improved socket drive tools. Another object of the present invention is to provide improved manually-powered socket drive tools. A further object of the present invention is to provide improved manually-powered socket drive tools which are relatively light weight, compact and simple in construction. An additional object of the present invention is to provide improved manually-powered socket drive tools which can be manufactured inexpensively and which requires little, if any, maintenance.

A specific object of the present invention is to provide an improved manually-powered socket drive tool means comprising a generally pistol-shaped tool having a barrel portion with a hand grip extending substantially perpendicularly from one end of the barrel portion, a socket drive shaft rotatably mounted in the barrel portion and projecting from the end of the barrel portion opposite the hand grip, a trigger lever pivotally connected adjacent the lower end of the hand grip, an arcuate drive gear connected to the upper end of the trigger lever for movement therewith, a differential gear means for coupling the drive gear to rotate the socket drive shaft, and reversing means for selectably connecting the trigger lever to rotate the differential gear means in a selected direction. A particular object of the invention is to provide a means by which the drive gear is easily and automatically engaged and disengaged with the driven portions of the tool and in which said means is not degraded by the need to also transfer drive power. Thus the functions of engagement/disengagement are separated from the function of drive force transfer. A final particular object of the invention is to provide a simple and easy to use means for changing rotational sense while using the tool. These and other objects and features of the present invention will be apparent from the following detailed description, taken with reference to the figures of the accompanying drawings.

DETAILED DESCRIPTION OF THE INVENTION

Figure 1:
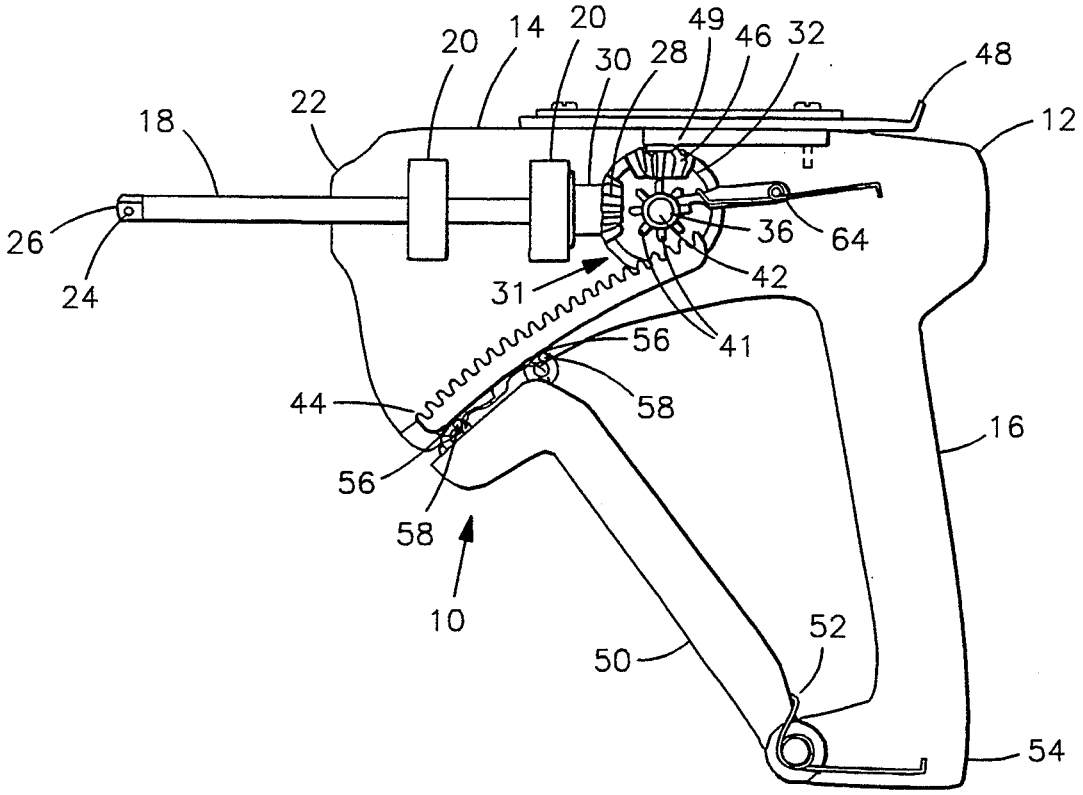
FIG. 1 is a vertical section through a manually-powered socket drive tool embodying the present invention, with the triggering lever in its extended position and the drive gear in its retracted position prior to the start of the drive stroke.
Figure 2:
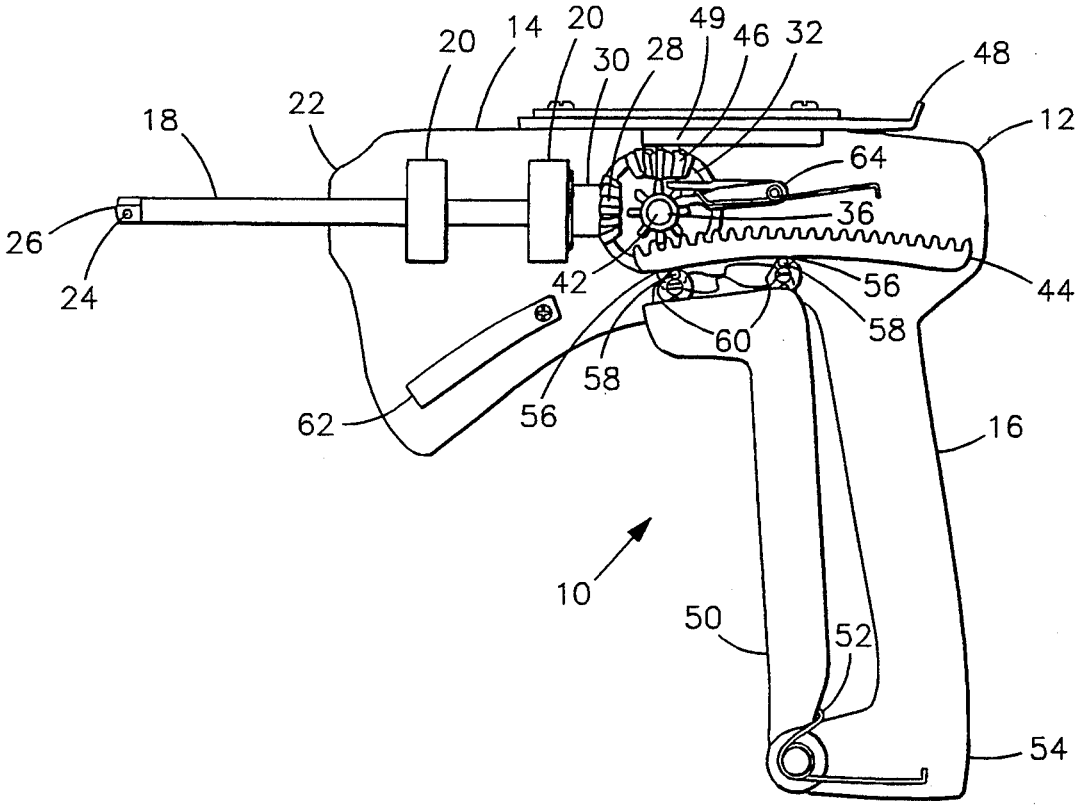
FIG. 2 is a view, similar to that of FIG. 1, with the triggering lever in its retracted position and the drive gear in its extended position depicting the end of the drive stroke and the start of the return stroke.
Figure 4:
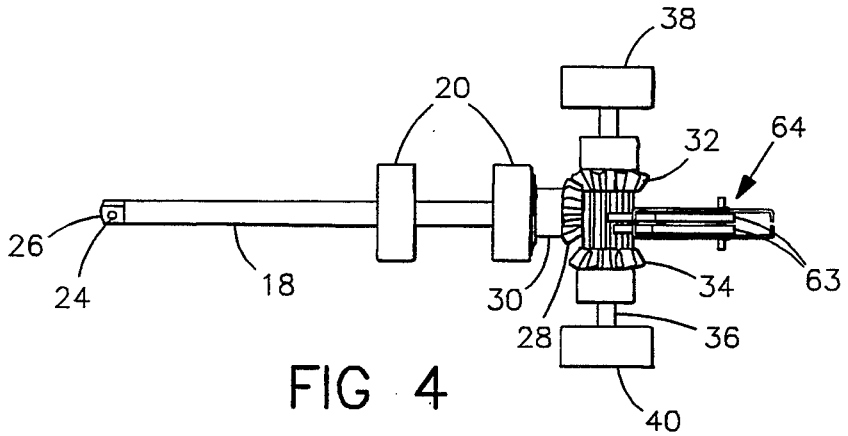
FIG. 4 is a diagrammatic representation of the drive mechanism of the socket drive tool of FIG. 1, with the swing arm and the reversing spur gear removed for clarity.
Figure 5:
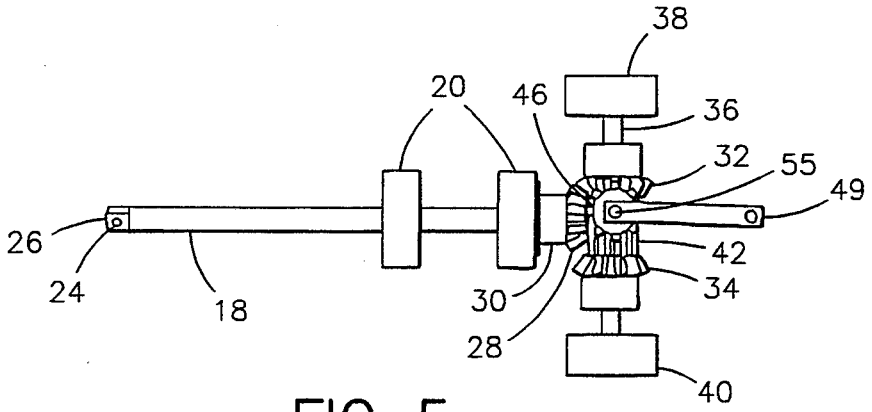
FIG. 5 is a view, similar to that of FIG. 4 with the swing arm and reversing spur gear shown in place.
Figure 6:
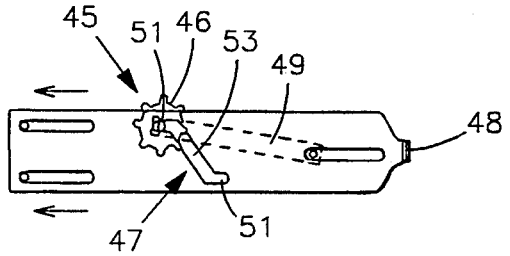
FIG. 6 is a detail view as seen from above the tool of FIG. 1, showing the reversing plate with its relationship to the swing arm.

FIGS. 1 and 2 illustrate details of the construction of the present invention. A hand operated tool drive device comprises a generally pistol-shaped housing 12 having a barrel portion 14 with a hand grip 16 extending substantially perpendicularly from one end and terminating in a lower end 54. A drive shaft 18 is rotatably mounted in the barrel portion 14 and projects from an opposite end 22, a differential gear means 31 couples driving force to the drive shaft 18 for rotation, and a triggering lever 50 pivotally connects the lower end 54 of the hand grip for movement of the lever 50 toward, and alternately, away from the hand grip 16. The lever 50 is pivotally mounted to, and extends from the lower end 54 toward the barrel portion 14 and terminates with an arcuate drive gear 44 for movement therewith, the drive gear 44 is pivotally attached to the lever 50 such that the movement of the lever 50 toward, and alternately away, from the hand grip 16 forces the drive gear 44 to move radially for engaging and alternately disengaging respectively the differential gear means 31 for providing driving force on each cycle of movement of the triggering lever between drive and return strokes. A spring 52 is positioned within the hand grip and the lever 50 so that the lever 50 is automatically returned to its starting position after each drive stroke. The differential gear means 31, as best shown in FIGS. 4 and 5, comprises a conical gear 28 fixedly mounted on a proximal end 30 of the drive shaft 18, held in rotational position by bearings 20, for rotation therewith, a pair of bevel gears 32, 34 selectably engagable with the conical gear 28, each serving to drive the conical gear 28 in an alternate respective rotational sense, means for selective engagement 45 (see FIG. 6) of a desired one of the bevel gears 32, 34 to engage the conical gear 28, and means for coupling 42, a ratchet gear, of the drive gear 44 to the bevel gears 32, 34. The bevel gears are mounted on a common shaft 36 held in the housing by laterally placed bearings 38 and 40, and are laterally slidable between alternate positions engaging the one or the other of the bevel gears 32, 34 with the conical gear 28. The means for selectably engaging 45 a desired one of the bevel gears 32, 34 with the conical gear 28 includes an idler gear 46 rotationally engaged on a swing arm 49 adapted for moving the idler gear 46 laterally for engaging the one or the other of the pair of bevel gears 32, 34. As best shown in FIG. 6, the engaging means 45 preferably includes a reversing plate 48 having a positioning slot 47 adapted for engaging the swing arm 49, as the reversing plate 48 slides on the housing 12 in linear motion, the swing arm 49 being forced to move laterally in correspondence with it. The positioning slot 47 preferably has an elongated "Z" shape providing a pair of laterally positioned slot legs 51 interconnected by a diagonal slot leg 53, the swing arm 49 providing a follower pin 55 (FIG. 5) engaged with the positioning slot 47 such that linear sliding motion of the plate 48 causes the swing arm 49 to shuttle between the leg slots 51. The leg slots correspond with the desired alternate bevel-conical gear engagement 28–32, 28–34. The reversing plate is sandwiched between the housing and a cover plate held by screws, but is able to slide over a limited linear distance necessary to move the follower pin from one slot leg 51 to the other slot leg and back again for rotational sense changes.

The means for coupling 45 of the drive gear 44 to the bevel gears 32, 34 is preferably a ratchet pinion gear 42 mounted on the common shaft 36 engagable by the drive gear 44 and further including a ratchet pawl and a pawl bias means 64, interconnected with the ratchet gear 42 for permitting rotation of the common shaft 36 in one selected rotational direction, while preventing rotation in the alternate sense. This is illustrated in FIGS. 2 and 4. The ratchet pawl and pawl bias means 64 preferably includes a pair of parallel pawl arms 63 pivotally extending into contact with the teeth of the ratchet gear 42, the arms 63 being of different lengths so that first one of the arms 63 and then the other of the arms 63 moves between successive teeth 41 of the ratchet gear 42 during rotation. This provides a limitation on rotational backlash of the ratchet gear 42 to approximately one-half tooth of the ratchet gear 42.

Figure 3A:
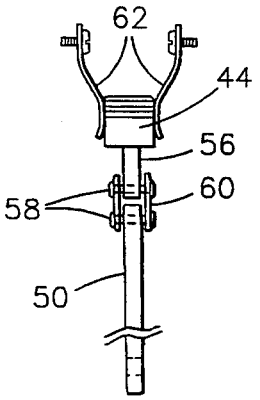
FIG. 3A is an end view of the triggering lever and the drive gear showing sliding contact with the friction plates.
Figure 3B:
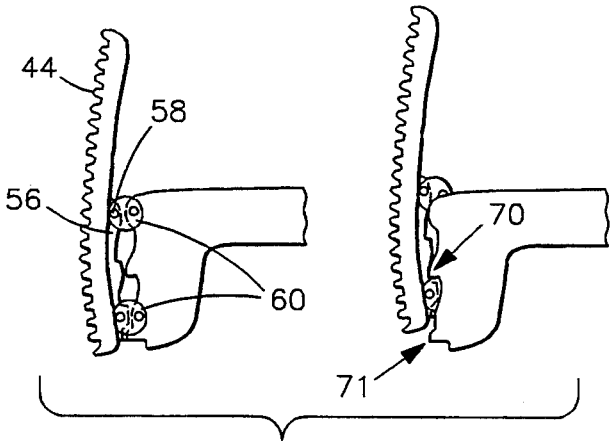
FIG. 3B is a detail side view of the drive gear and triggering lever illustrating the drive gear in both retracted and extended positions.

At least one friction plate 62, shown in FIGS. 2 and 3A, is preferably positioned in sliding engagement with the drive gear 44 for urging the latter into, and alternately out of, engagement with the ratchet gear 42. The friction plates 62 are preferably flat springs which rub on the sidewalls of the drive gear such that the drive gear tends to move to the extended position during the drive stroke, and to the retracted position during the return stroke. The drive gear pivots on a link means 60 pivotally interconnecting the drive gear 44 with the triggering lever 50, depending upon the direction of motion of the drive gear 44. As shown in FIGS. 3A and 3B, the link means 60 are preferably disk shaped and are pivotally secured to the drive gear and the triggering lever with pins 58. The drive gear 44 and the triggering lever 50 each preferably include a set of integral lobes 70, again best shown in FIG. 3B, each set being arranged linearly such that with the drive gear 44 positioned into the extended position for engagement with the ratchet gear 42, the respective lobes 70 of the drive gear 44 rest upon the lobes of the triggering lever 50 in order to support the drive gear 44 for assured engagement with the ratchet gear 42 during the drive stroke which also assures that the pivot pins 58 do not absorb the drive force pressures, while with the drive gear 44 positioned out of engagement with the ratchet gear 42, the respective lobes 70 of the drive gear 44 are positioned between the lobes 70 of the triggering lever 50 in order to permit room for the drive gear 44 to disengage from the ratchet gear 42 on the return stroke when the drive gear is in the retracted position. In the preferred embodiment, the trailing lobes 71 of the drive gear 44 and the triggering lever 50 make side-to-side contact when the drive gear 44 is extended, thereby preventing the drive gear 44 from pivoting beyond the point of maximum gear engagement.

Obviously, numerous variations and modifications can be made without departing from the spirit of the present invention. Therefore, it should be clearly understood that the form of the present invention described above and shown in the figures of the accompanying drawings is illustrative only and is not intended to limit the scope of the present invention.

What is claimed is:

1. A hand operated tool drive device comprising:

a generally pistol-shaped housing having a barrel portion with a hand grip extending substantially perpendicularly from one end thereof and terminating in a lower end;

a drive shaft rotatably mounted in the barrel portion and projecting from an opposite end thereof;

a differential gear means coupling driving force to the drive shaft for rotation of same, and a triggering lever pivotally connected to the lower end of the hand grip for movement of the lever toward, and alternately, away from the hand grip, the lever extending therefrom toward the barrel portion and terminating with an arcuate drive gear for movement therewith, the drive gear pivotally attached to the lever such that the movement of the lever toward, and alternately away, from the hand grip forces the drive gear to move radially for engaging and alternately disengaging respectively the differential gear means for providing driving force on each cycle of movement of the triggering lever between drive and return strokes.

2. The device of claim 1 wherein the differential gear means comprises a conical gear fixedly mounted on a proximal end of the drive shaft for rotation therewith, a pair of bevel gears selectably engagable with the conical gear, each serving to drive the conical gear in an alternate respective rotational direction, means for selectably causing a desired one of the bevel gears to engage the conical gear, and means for coupling the drive gear to the bevel gears.

3. The device of claim 2 wherein the bevel gears are mounted on a common shaft laterally slidable between alternate positions engaging the one or the other of the bevel gears with the conical gear.

4. The device of claim 3 wherein the means for selective engagement of a desired one of the bevel gears to engage the conical gear is an idler gear rotationally engaged on a swing arm adapted for moving the idler gear laterally for engaging the one or the other of the pair of bevel gears for moving the common shaft.

5. The device of claim 4 wherein the causing means includes a reversing plate having a positioning slot adapted for engaging the swing arm, the reversing plate sliding on the housing in linear motion between a first and a second positions, the swing arm being forced to move laterally in correspondence therewith.

6. The device of claim 5 wherein the positioning slot has an elongated "Z" shape providing a pair of laterally positioned slot legs interconnected by a diagonal slot leg, the swing arm providing a follower pin engaged with the positioning slot such that linear sliding motion of the plate causes the swing arm to shuttle between the leg slots said positions corresponding with desired bevel-conical gear engagement.

7. The device of claim 3 wherein the means for coupling the drive gear to the bevel gears is a ratchet gear mounted on the common shaft engagable by the drive gear and further including a ratchet pawl and a pawl bias means, interconnected with the ratchet gear for permitting rotation of the common shaft in one selected rotational direction, while preventing rotation in the alternate sense.

8. The device of claim 7 wherein the ratchet pawl and pawl bias means includes a pair of parallel pawl arms pivotally extending into contact with the ratchet gear, the arms being of different lengths so that first one of the arms and then the other of the arms moves between successive teeth of the ratchet gear during rotation, the arms thereby limiting rotational backlash of the ratchet gear to approximately one-half tooth of the ratchet gear.

9. The device of claim 1 further comprising at least one friction plate positioned in sliding engagement with the drive gear for urging the latter into, and alternately out of, engagement with the ratchet gear, the drive gear pivoting on a link means pivotally interconnecting the drive gear with the triggering lever, in accordance with the direction of motion of the drive gear.

10. The device of claim 8 wherein the drive gear and the triggering lever each include a set of integral lobes each said set arranged linearly, such that with the drive gear positioned into engagement with the ratchet gear, the respective lobes of the drive gear rest upon the lobes of the triggering lever in order to support the drive gear there against for assured engagement with the ratchet gear during the drive stroke while with the drive gear positioned out of engagement with the ratchet gear, the respective lobes of the drive gear are positioned between the lobes of the triggering lever in order to permit the drive gear to disengage from the ratchet gear on the return stroke.

* * * * *